United States Patent [19]

Ares et al.

[11] Patent Number: 4,621,505

[45] Date of Patent: Nov. 11, 1986

[54] FLOW-THROUGH SURGE RECEIVER

[75] Inventors: Roland A. Ares, St. Charles; James M. Cromer, Florissant; Wayne G. Schaeffer, Creve Coeur; William C. Wehmeier, St. Charles, all of Mo.

[73] Assignee: Hussmann Corporation, Bridgeton, Mo.

[21] Appl. No.: 761,426

[22] Filed: Aug. 1, 1985

[51] Int. Cl.[4] ..... F25B 39/04

[52] U.S. Cl. ..... 62/509; 62/196.4; 62/510

[58] Field of Search ..... 62/509, 510, 196.4, 62/DIG. 17

[56] References Cited

U.S. PATENT DOCUMENTS

| | | | |
|---|---|---|---|
| 2,986,899 | 6/1961 | Schenk et al. | 62/DIG. 17 X |
| 3,103,795 | 9/1963 | Tilney | 62/DIG. 17 X |
| 3,150,498 | 9/1964 | Blake | 62/510 X |
| 3,343,375 | 9/1967 | Quick | 62/510 X |
| 3,358,469 | 12/1967 | Quick | 62/510 X |
| 3,427,819 | 2/1969 | Seghetti | 62/509 X |
| 3,525,234 | 8/1970 | Widdowson | 62/509 X |
| 3,905,202 | 9/1975 | Taft et al. | 62/510 X |
| 4,012,921 | 3/1977 | Willitts et al. | 62/509 X |
| 4,167,102 | 9/1979 | Willitts | 62/509 X |
| 4,214,453 | 7/1980 | Barrow | 62/509 X |
| 4,231,229 | 11/1980 | Willitts | 62/509 X |
| 4,328,682 | 5/1982 | Vana | 62/196.4 |
| 4,430,866 | 2/1984 | Willitts | 62/509 X |
| 4,457,138 | 7/1984 | Bowman | 62/509 X |
| 4,522,037 | 6/1985 | Ares et al. | 62/196.4 |

*Primary Examiner*—Albert J. Makay
*Assistant Examiner*—Steven E. Warner
*Attorney, Agent, or Firm*—Richard G. Heywood

[57] ABSTRACT

A flow-through surge receiver for a refrigeration system having compressor, condenser and evaporator means, in which a surge-type receiver forms a reservoir for liquid refrigerant and has a flow-through conduit receiving refrigerant from the condenser means and an outlet for passing such refrigerant directly to the evaporator means in by-pass relation with the receiver reservoir, and a passageway for establishing fluid communication between said conduit and reservoir below the normal liquid refrigerant level in the reservoir.

15 Claims, 1 Drawing Figure

FLOW-THROUGH SURGE RECEIVER

BACKGROUND OF THE INVENTION

The invention relates generally to the commercial and industrial refrigeration art, and more particularly to improvements in low head pressure surge-type receivers for refrigeration systems.

In the past, closed refrigeration systems having a single compressor or plural compressors have been used in commercial installations, such as supermarkets having a large number of low and/or normal temperature refrigerated fixtures or units for the display and storage of food products, or for industrial installations such as warehousing, lockers, manufacturing plants and the like having varying refrigeration requirements.

Hot gas defrosting in such systems is effective due to the large latent heat load produced by the refrigerated units in excess of the heat required for defrosting selected evaporator coils during the continued refrigeration of the remaining fixtures. However, highly superheated hot gas from the compressor for defrosting purposes has resulted in breakage and leaks caused by rapid thermal expansion of refrigerant lines, and the fog or vapor caused by high defrost temperatures frequently is visual in the refrigerated fixture or zone and may result in frost buildup on products. U.S. Pat. No. 3,343,375 teaches that the adverse effects of prior hot gas defrosting can be obviated by using saturated gas taken from the receiver or otherwise being desuperheated. It is also generally known in the refrigeration industry that subcooled liquid refrigerant from the condenser is advantageous in the operation of the evaporators and that low compressor head pressures result in substantial energy savings, and surge receiver systems to obtain these benefits, as well as utilize saturated gas defrost, are disclosed in U.S. Pat. Nos. 3,358,469; 3,427,819 and 4,522,037.

Refrigeration system operations throughout the year are directly affected by various climatic conditions. For instance, during winter operations the maintenance of proper compressor head pressures in the high side of the system has been a principal problem, particularly in recent years in which heat reclamation condensers have come into wide-spread usage; and during summer operations in which the machine room temperature was frequently below the condensing temperature of a roof-mounted or outside condenser, the supply of saturated gas for defrosting was severely limited or substantially non-existent due to its condensation to liquid form and overfill "lugging" of the receiver.

In short, prior systems having either flow-through or surge receivers and utilizing saturated gas defrost and winter heat reclamation condensers have had various high side control problems throughout the various climatic seasonal changes and effects on such systems and, while various control arrangements have been proposed, year-round system operations have not been efficiently controlled heretofore.

SUMMARY OF THE INVENTION

The invention is embodied in a refrigeration system having compressor, condenser, surge receiver and multiple evaporators for fixture or zone cooling, in which the surge receiver has an internal direct flow-through conduit means with an inlet end connected to the condenser and an outlet end for passing refrigerant directly to a liquid header for feeding the evaporators, the outlet end having a fluid connection to the receiver reservoir adjacent to the bottom below the liquid level normally maintained in the reservoir thereby maintaining a hydrostatic seal, and surge control valve means for the surge receiver responsive to liquid header temperatures for regulating refrigerant pressures and flow within the surge receiver.

The principal object of the present invention is to provide a novel flow-through receiver having surge characteristics for maintaining liquid refrigerant subcooling from the condenser in the liquid line to the evaporators.

Another object is to provide a surge receiver and refrigeration system high side control arrangement that will permit the compressor head pressure to vary widely while maintaining an operation balance in system pressures relative thereto.

An object of the present invention is to permit the compressor head pressure to self-adjust or "float downwardly" within limits to provide natural subcooling and more efficient refrigeration at substantial energy savings.

Another object is to provide for predetermined surge receiver gas and pressure make-up in response to receiver liquid levels and saturated gas defrost operations.

These and still other objects and advantages will become more apparent hereinafter.

DESCRIPTION OF THE DRAWINGS

For illustration and disclosure purposes the invention is embodied in the parts and the combinations and arrangements of parts hereinafter described and claimed. In the accompanying drawings which form a part of the specification and in which like numerals refer to like parts wherever they occur:

DESCRIPTION OF THE PREFERRED EMBODIMENTS

Figure 1:
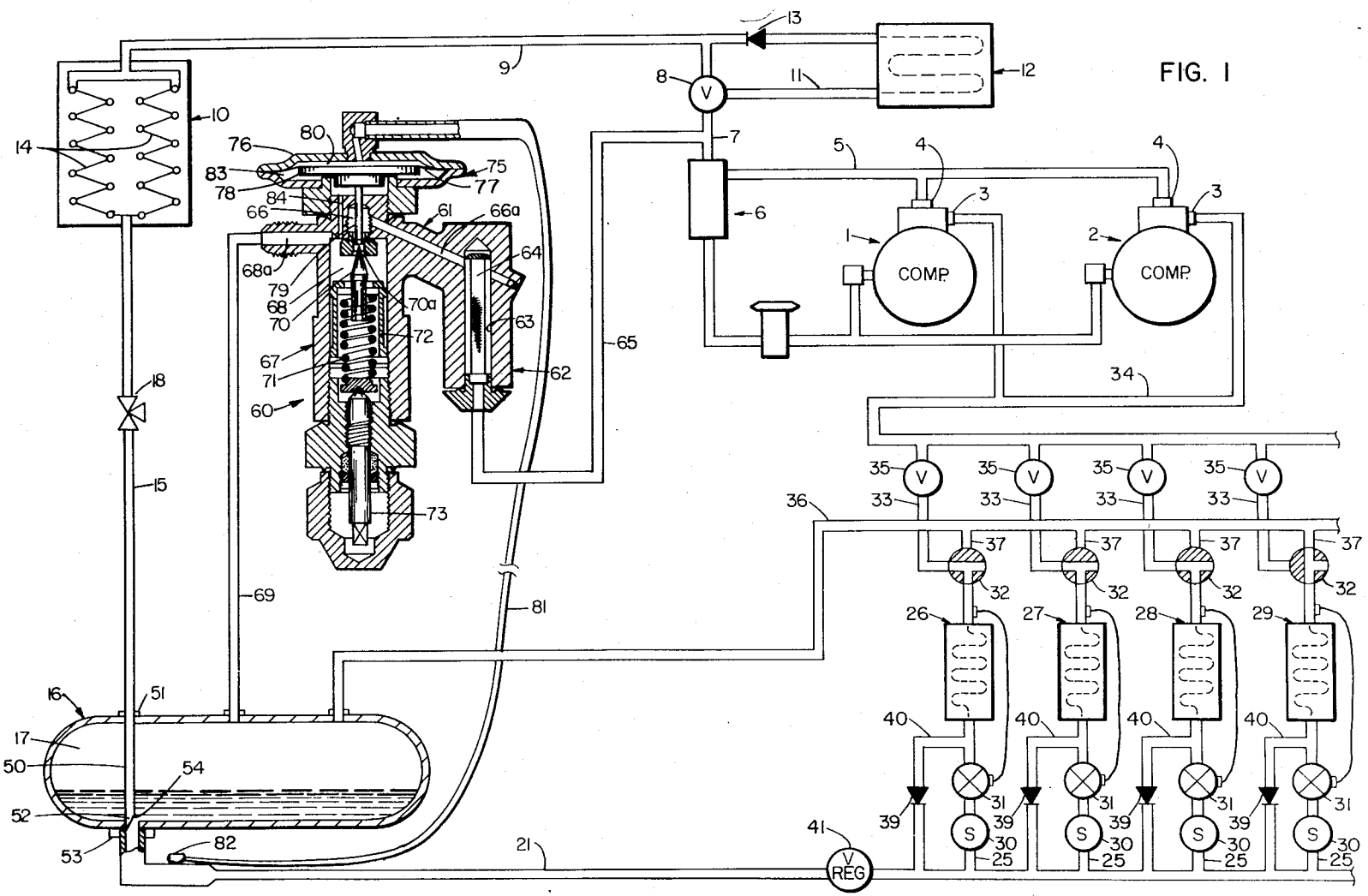
FIG. 1 is a diagrammatic view of a typical refrigeration system embodying a presently preferred form of the invention.

For disclosure purposes, a closed refrigeration system embodying the invention is illustrated and will be described as being of the multiplexed type having dual or twin parallel compressors and which might be installed in a supermarket for operating a plurality of separate fixtures, such as refrigerated food storage and display cases, but it will be understood and readily apparent to those skilled in the art that the invention is useful on single compressor systems having parallel or like remote condensers or on other commercial or industrial refrigeration installations. The term "high side" is used herein in a conventional refrigeration sense to mean the portion of the system from the compressor discharge to the evaporator expansion valves, and the term "low side" means the portion of the system from the expansion valves to the compressor suction.

Referring to FIG. 1, the refrigeration system shown is in part conventional and includes a pair of compressors 1 and 2 connected in parallel and each having a suction or low pressure side with a suction service valve 3 and operating within a predetermined range of suction pressures and having a discharge or high pressure side 4 connected to a common discharge header 5 through which hot compressed gaseous refrigerant is discharged for condensing operations. The discharge header 5 is connected to an oil separation system 6, in which oil is separated from the hot gaseous refrigerant and is collected and returned to the compressors 1 and 2. The refrigerant outlet from the oil separator 6 is connected to a high side discharge conduit 7 through which hot refrigerant vapor is conducted to a three-way valve 8 for selective operation to connect directly to conduit 9 to an outdoor or roof-top condenser 10 or through line 11 to an indoor heat reclaim condenser coil 12, which in turn is connected in series through one-way check valve 13 to the outside condenser 10 to perform the final and principal function of condensing the refrigerant to its saturation temperature. It will be understood that the reheat coil 12 is operable during the winter heating season to reclaim the superheat of compression from the refrigerant vapor for use in heating room air in the supermarket or store, but that the condensing temperature of the refrigerant is reached in the outdoor condenser 10 to obviate refrigerant liquid and pump-out problems in the heat reclaim coil 12 as more fully discussed in U.S. Pat. No. 3,358,469.

The refrigerant is reduced to its condensing temperature and pressure in the condenser 10 which is disclosed as having parallel coil passes 14 with a single outlet connected by a conduit 15 to a surge-type receiver 16 embodying the invention as will be discussed. The receiver has a reservoir 17 and forms part of the liquid refrigerant source for operating the system. A pressure responsive flooding valve 18 may be provided in the conduit 15 for operation in extreme winter conditions to restrict condensate flow from the condenser and produce variable condenser flooding to maintain a preselected minimum compressor head pressure. A liquid line header 21 is provided at the outlet from the receiver 16 for conducting liquid refrigerant to branch liquid lines or conduits 25 leading to evaporator coils 26, 27, 28 and 29 associated with different refrigerated fixtures (not shown) and being representative of numerous evaporators that may be connected into the refrigerant system. The branch liquid line 25 of each evaporator 26, 27, 28 and 29 has a solenoid valve 30, and thermostatic expansion valves 31 meter refrigerant into the evaporators in a conventional manner. The outlets of the evaporators are connected to three-way valves 32 and, under normal refrigerating operation, are connected through these valves and branch suction lines or conduits 33 to a suction header 34 connected to the suction side 3 of the compressors 1 and 2 and through which vaporous refrigerant from the evaporators is returned to the compressors to complete the basic refrigeration cycle. Evaporator pressure regulator (EPR) valves 35 are shown interposed in the branch suction lines 33 to illustrate that the suction pressure on the evaporator coils 26, 27, 28 and 29 can be adjusted so that the respective refrigerated fixtures can operate at different temperatures within the range of the suction pressures established by the compressors 1 and 2.

The refrigeration system so far described operates in a conventional manner in that each fixture evaporator absorbs heat from the fixture or its produce load thereby heating and vaporizing the refrigerant and resulting in the formation of frost or ice on the evaporator coils. Thus, the refrigerant gas returned to the compressor has a cumulative latent heat load in excess of the amount of heat required to defrost one or more of the evaporators 26–29. A main gas defrost header 36 is provided for conducting saturated gaseous refrigerant selectively to the evaporator coils and is connected through branch defrost lines or conduits 37 to the three-way valves 32, the three-way valve for the evaporator 29 being shown in defrost position. In a conventional "hot gas" defrost arrangement, the gas header 36 would be connected to the compressor discharge conduit 7 downstream of the oil separator and reservoir unit 6 to provide a source of highly superheated compressed refrigerant vapor for selectively defrosting the evaporators 26–29. However, the present system discloses "saturated gas" defrosting in which the sensible and latent heat of gaseous refrigerant at its desuperheated or saturation temperature is used for defrosting the evaporators. Thus, the gas defrost header 36 is connected to the top of the surge receiver 16 so that saturated gaseous refrigerant flows through the header 36, the branch line 37 and the three-way valve 32 into the evaporator coil 29 (or other selected evaporator) for heating and defrosting the coil thereby condensing the refrigerant to a liquid as in a conventional condenser. The solenoid valve 30 is closed to isolate the defrosting evaporator from its normal refrigeration connection to the liquid line 25, and a check valve 39 is provided in by-pass line 40 around the expansion valve 31 to return the defrost condensate to the liquid line 21 as taught by U.S. Pat. No. 3,150,498 so that such refrigerant condensate is immediately available for use in the normal operation of the refrigerating evaporators. A pressure reducing or regulating valve 41 or the like is positioned in the liquid header 21 between the branch liquid supply lines 25 and the surge receiver 16 to effect a downstream pressure reduction in the range of 10–20 psig in the liquid line 21 relative to the pressure in the defrost header 36.

Those skilled in the refrigeration art will understand and appreciate the seasonal climatic influence on large commercial and industrial refrigeration systems of the type disclosed. Obviously, the primary function of the system is to provide efficient year-round refrigeration of the respective fixtures or units cooled by the evaporator coils 26–29, and the most efficient refrigeration is obtained by delivering subcooled liquid refrigerant to the expansion valves 31. Such subcooling is obtained inherently during winter and intermediate seasons by using conventional condenser flooding or other condenser capacity restrictions to control or maintain the minimum compressor head pressure requisite for total system operation, and the use of surge receivers are known to enhance this natural subcooling effect by stratification of liquid in the receiver reservoir 17, as will appear. Thus, such subcooling can result in substantial energy or power savings unless it has to be obtained by offsetting power usage as in the operation of the subcooler 42, which therefore is only operated when natural subcooling is not otherwise obtained. Similarly, the use of heat reclaiming coil 12 will result in substantial energy or power savings during most winter and intermediate seasons depending upon the cost of electrical power for running the compressors 1 and 2 and the relative cost of the fuel which may be used for supplemental store heating. Obviously, if the operating head pressure is increased there will be an increase in the heat reclamation potential of the coil 12 but at a higher power consumption by the compressors 1 and 2. These substantial energy savings can be obtained by permitting the compressor head pressure to float downwardly to the lowest point at which system refrigeration will be efficiently provided without causing or inducing refrigerant vapor or flash gas into the liquid lines 15 and 21. It will be clear that in summer operations when the ambient is above 85° to 90° F., the condensation temperature and head pressures will be higher and little or no economic benefit can be expected. However, during winter and intermediate seasonal operations, lower head pressures alone will produce about 1% energy savings for each temperature degree of lower compressor head pressure operation, and below an ambient temperature of about 55° F. an additional 0.5% kilowatt savings will be realized by reason of subcooling.

In a conventional flow-through receiver, the conduit (15) connection from the condenser (10) is made at the top of the receiver tank 16 so that all refrigerant condensate is discharged openly into the reservoir (17) and establishes a substantially uniform saturation temperature of the gas and liquid therein with the incidental loss of any effective subcooling. In a typical surge receiver arrangement, the receiver (16) has its only fluid connection from its base or bottom into the system, and the condenser conduit (15) is generally connected to this base and in a direct, in-line connection to the liquid line header (21) so that subcooled liquid will flow directly to the evaporators and by-pass the receiver. Thus, conventional surge receivers obtain temperature stratification with saturated gas temperatures at the top and subcooled liquid refrigerant at the bottom.

The surge-type receiver 16 of the present invention obtains the benefit of both the conventional flow-through receiver and the conventional surge receiver. According to the invention, the receiver 16 is provided with a vertical standpipe or flow-through conduit 50 connected to or formed integral with the condenser conduit 15 at the top 51 of the receiver and extending vertically through the reservoir 17. The lower outlet end 52 of the standpipe extends into the receiver outlet connection 53 to the liquid header 21 at the bottom of the reservoir 16, and the outlet end 52 is also provided with an angular, beveled or contour cut, at 54, so that the outlet end 52 forms a passageway opening directly into the resevoir chamber 17 along the bottom margrn of this chamber. The vertical standpipe 50 is inexpensively assembled, as in conventional flow-through receiver construction, and the liquid refrigerant from the condenser 10 is conducted through the reservoir 17 out of contact with the stratified gas and liquid temperature layers therein, thereby preserving the integrity of subcooled condensate, as in conventional surge receivers. The flow-through surge receiver 16 of FIG. 1 is a horizontal receiver in that the reservoir 17 has its major elongated dimension extending in a horizontal plane, but the invention also is applicable to so-called vertical receivers in which the receiver tank has a major vertical dimension, as is well known in the refrigeration industry. Thus, it will be clear that in a vertical receiver, the liquid header 21 will extend horizontally and have its inlet end 53 opening into the reservoir 17 adjacent to the bottom thereof, and the flow-through conduit 50 will also extend horizontally concentrically with the liquid header 21 across the bottom of the reservoir 17 and have its discharge or outlet end 52 projecting into the inlet end 53 of the header 21 so that these conduits 50 and 21 form an in-line flow-through connection for the direct discharge of subcooled refrigerant from the condenser 10 directly into the liquid header 21. The beveled cut 54 can be made on any side of the outlet end 52 to provide fluid communication with the reservoir 17 at the bottom below the liquid level therein.

It will be apparent that a refrigerant liquid seal encases the discharge end 52 of the standpipe conduit by reason of the location of the angled cut 54 at the bottom of the reservoir 17 below the normal liquid refrigerant level therein. The purpose of this liquid seal is to permit a gently induced outflow of the minimum subcooled receiver liquid that occurs in response to the slight hydrostatic pressurization within the receiver by operation of surge control valve 60 with a resultant refrigerant outflow from the receiver reservoir 17 to satisfy the system evaporator demands. It is clear that in a multiplex line-up of refrigeration system evaporators 26–29, the system expansion valves 31 are constantly modulating between fully closed and open positions to throttle refrigerant from the liquid line 21 to meet the refrigeration requirements of the respective fixtures, and that some of this demand is provided by the inflow of defrost condensate directly into the liquid line 21. Thus, in some systems under certain operating conditions reverse refrigerant flow in the liquid line 21 at its inlet 53 may occur and create inflow conditions into the reservoir 17 at the contour cut passageway 54 that will increase the liquid level in the reservoir 16, and the contour cut 54 of the by-pass flow-through conduit 50 will accommodate such flow back-up into the receiver 16 although the desired flow characteristic normally achieved is the control of induced liquid refrigerant outflow from the receiver.

The dynamics of liquid refrigerant flow out of the receiver reservoir 17 directly effects pressurization therein, and a surge control valve 60 is provided for maintaining a substantially constant receiver pressure in response to variable refrigerant flow rate in the liquid line 21 and saturated gas depletion from the receiver 16 during defrost. The control valve 60 has a main valve body 61 with an inlet filter unit section 62 having an inlet chamber 63 which houses a refrigerant filter 64 and is connected by conduit 65 to the high side discharge conduit 7 and is also internally ported through port **66*a* to a central main inlet chamber 66 in the valve body 61. A central valve section 67 in the body 61 has a main outlet chamber 68 connected through outlet port 68*a* to receiver conduit 69 connected to the top of the reservoir 17. Refrigerant flow communication between the main inlet chamber 66 and main outlet chamber 68 is controlled by a needle valve element 70 biased upwardly toward seating engagement on valve seat 70*a* by pressure spring 71 acting on a valve carrier or cage member 72 slidable in the central valve section 67, and the pressure exerted by the spring 71 is variably controlled by an adjustment member 73 threaded in the lower end of the housing 61. The surge control valve 60 works on a fluid pressure differential basis, and the valve 60 includes an upper valve control section 75 having a control head 76 with a diaphragm 77 acting against a control plate 78 having a valve element push rod 79 extending through the inlet chamber 66 and adapted to unseat the valve element 70 in response to such differential pressure. An upper pressure chamber 80 above the diaphragm 77 is connected by pressure line 81 to a sensing bulb 82 attached to liquid line 21 adjacent to the receiver 16, and a lower chamber 83 below the diaphragm 77 connects through an internal equalizing port 84 with the main outlet chamber 68. Thus, the diaphragm 77 is acted on by the upward force of the effective receiver pressure prevailing in the lower chamber 83 tending to move the plate 78 and push rod 79 upwardly away from the valve element 70 which, together with the force of spring 71, effects seating engagement of the valve element 70 on seat 70*a*. It will be understood that instead of using the internal equalizing port 84 as shown, an external equalizing line may connect the lower diaphragm chamber 83 to be equalized to the pressure of the receiver reservoir 17, as at line 69, or to the liquid header 21 immediately adjacent to the sensing bulb 82 whereby any change in the pressure-temperature relationship of the receiver 16 effective in the liquid header 21 will be detected by the bulb 82 for modulating action of the control valve 60**.

The sensing bulb 82 and upper chamber 80 contain a pressure charge that is responsive to the temperature in the liquid line 21 and transmits a variable and opposing pressure to the diaphragm 72 in the upper chamber 80 in response to temperature-pressure changes in the liquid header 21. Since an object of the invention is to maintain natural condenser subcooling of the refrigerant in the liquid line 21 and also permit the compressor head pressure to float downwardly, the pressure charge in the sensing bulb 82 and upper pressure chamber 80 of the valve 60 is determined on the basis of the design refrigerant saturation pressure-temperature of the condenser 10 for the refrigeration system to obtain maximum subcooling at a typical seasonal ambient temperature (and altitude or ambient pressure may become a factor in the pressure charge selection). Thus, with a 55° F. ambient and a design saturation temperature of 75° F. and 15° F. subcooling, the condensing pressure for Refrigerant 502 will be 148 psig at sea level and the compressor head pressure will be about 154 psig. The pressure charge for the surge control valve 60 will be selected to maintain a receiver pressure of about 150 psig or within the intermediate range between the condensing pressure and compressor head pressure, and this relationship will be maintained throughout the ambient seasonal temperature changes although the amount of subcooling may vary from about 25° F. in the winter to possibly as low as 1° F. in the summer.

In the operation of the refrigeration system there will normally be a supply of liquid refrigerant in the surge-type receiver 16 of the present invention with temperature gradation in the reservoir 17 having warmer saturated gas at the top and slightly subcooled liquid at the bottom forming a liquid seal effective around the discharge end of the flow-through conduit 50 and outlet opening 54 therefrom. Liquid refrigerant condensate from the condenser 10 passes through the flow-through conduit 50, thus preventing its cooling contact with the gas layer so that natural subcooling is not transferred to the warmer gas. This subcooled refrigerant condensate is in liquid form and discharges through the standpipe 50 directly into the liquid header 21 to form the primary liquid refrigerant source for the evaporators 26–29. The refrigerant liquid seal in the reservoir 17 which encases the discharge end of the standpipe 50 thus holds a thermal barrier or boundary in the standpipe, except to the extent of the receiver volumetric outflow rate that is normally maintained to prevent rupture of this seal inwardly into the reservoir 17 during the normal operation of satisfying the refrigeration requirements of the evaporators 26–29. This outflow rate of liquid refrigerant from the receiver will be compensated for by hydrostatic condensing of compressor discharge gas metered into the reservoir 17 by the surge control valve 60 thereby effecting a balanced receiver condition maintaining the liquid level seal around the opening 54 at a predetermined pressure. It will be understood that some amount of condensing continuously occurs within the receiver 16 as the hydrostatic gas pressure is implied on the liquid refrigerant surface thereby maintaining a saturated gas temperature, and that the pressure drop in the receiver 16 resulting from gas defrost operations will be compensated by the opening of the control valve 60 to maintain a pressurized gas supply in the receiver. It is understood that the invention is not limited to saturated gas defrost in the refrigeration system, and that hot gas defrost or conventional electric or air defrost arrangements may be employed in defrosting the evaporators 26–29 of the system.

The control valve 60 is operated by the opposing forces exerted in the pressure head section 75, and decreasing pressure in the receiver reservoir 17 also acting in the lower chamber 83 will cause the valve element 70 to be unseated and pressure flow established between the head pressure inlet chamber 63,66 and the outlet chamber 68 to maintain the receiver-condensing pressure relationship. When the receiver pressure is in equilibrium at about 0.5–4 psi higher than the condenser pressure, the control valve 60 will be modulated to a closed position. The small amount of liquid outflow from the receiver 17 is normally maintained along with the flow of subcooled refrigerant condensate into the liquid header 21 and the control valve 60 will thus modulate constantly to maintain the receiver pressure. The sensing bulb 82 also senses temperature change in liquid line 21, and higher liquid line temperatures will produce higher pressures in the pressure charge of the sensing bulb 82 and upper pressure chamber 80 thereby actuating the diaphragm 77 downwardly to open the valve element 70 and increase the receiver pressure proportionally.

It will be readily apparent to those skilled in the art that changes and modifications can be made in the present invention, which is limited only by the scope of the appended claims.

What is claimed is:

1. A flow-through surge receiver for a refrigeration system having compressor, condenser and evaporator means, said surge receiver comprising a receiver tank to form an internal reservoir for liquid refrigerant between said condenser and evaporator means, a flow-through refrigerant conduit for said receiver tank having an inlet end connected to the condenser means for receiving condensed subcooled liquid refrigerant therefrom and an outlet end constructed and arranged to pass such condensed subcooled liquid refrigerant from said condenser means directly to the evaporator means without first passing through the internal reservoir, and said flow-through conduit including passageway means for establishing open fluid communication with said reservoir at a point below the normal level of liquid refrigerant therein.

2. The flow-through surge receiver according to claim 1, in which a liquid header is connected to said surge receiver adjacent to the bottom thereof, and the outlet end of said flow-through refrigerant conduit is oriented to discharge refrigerant condensate directly into said liquid header.

3. The flow-through surge receiver according to claim 2, in which said liquid header has a vertical section with an upper end opening into the bottom of said receiver reservoir, and said flow-through refrigerant conduit comprises a vertical standpipe with at least a portion of its outlet end extending into the vertical section of said liquid header.

4. The flow-through surge receiver according to claim 3, in which the outlet end of said vertical standpipe has an angled cut forming said passageway means, the upper edge of said angled cut being positioned above the bottom of said receiver reservoir and below the normal level of liquid refrigerant therein.

5. The flow-through surge receiver according to claim 4, in which the liquid refrigerant in said receiver reservoir forms a liquid seal encasing the lower outlet end of said vertical standpipe, and said angled cut accommodates outflow and inflow of liquid refrigerant between said reservoir and liquid header in response to refrigerant demands of said evaporator means.

6. The flow-through surge receiver according to claim 1, including surge control valve means responsive to variations in the pressure-temperature relationship in said surge receiver relative to the design saturation pressure-temperature of refrigerant from the condenser means for maintaining the reservoir pressure at a predetermined value and for maintaining liquid refrigerant levels in said reservoir through hydrostatic condensing therein.

7. The flow-through surge receiver according to claim 6, in which said surge control valve means modulates between closed and open positions to maintain the receiver pressure at a value higher than the condensing pressure of said condenser means.

8. The flow-through surge receiver according to claim 7, in which said control valve means is modulated to an open position in response to decreasing receiver pressure.

9. A flow-through surge receiver in a refrigeration system having compressor, condenser and evaporator means, said surge receiver forming an internal reservoir as a liquid refrigerant source for said system and having a liquid line header connected to the bottom of said receiver for delivering liquid refrigerant to the evaporator means upon demand, condenser conduit means connecting said condenser means to said surge receiver, and flow-through conduit means extending through said surge receiver and having an inlet end connected to receive refrigerant condensate from said condenser conduit means and an outlet end constructed and arranged to discharge such refrigerant condensate directly into said liquid line header in by-pass relation to the liquid refrigerant in said internal reservoir, and said outlet end including passageway means for accommodating outflow and inflow of liquid refrigerant between said reservoir and liquid header in response to refrigerant conditions prevailing in said liquid line header due to the refrigerant demands of said evaporator means.

10. A flow-through surge receiver in a refrigeration system having compressor, condenser and evaporator means, said surge receiver comprising a receiver tank forming an internal reservoir for liquid refrigerant between said condenser and evaporator means, a flow-through conduit extending through said receiver tank and having an inlet end connected directly to said condenser means and an outlet end connected to discharge refrigerant condensate to said evaporator means, said flow-through conduit directly passing refrigerant condensate therethrough to said outlet and without discharging such refrigerant condensate into and through said internal reservoir, said flow-through conduit having passage means at said outlet end for establishing fluid communication with said reservoir below the liquid level of refrigerant therein thereby forming a hydrostatic seal around such passage means, and other means for delivering high pressure refrigerant into said reservoir to maintain such liquid level and hydrostatic seal and to normally provide refrigerant outflow from said reservoir through said passage means.

11. The flow-through surge receiver according to claim 10, including a liquid header connected to said evaporator means and having a section with an inlet end in fluid communication with liquid refrigerant in said reservoir adjacent to the bottom thereof, and the outlet end of said flow-through conduit being positioned for the discharge of liquid refrigerant condensate from said condenser means directly into the inlet end to said section of said liquid header.

12. The flow-through surge receiver according to claim 11, in which said passage means from said flow-through conduit opens into said receiver reservoir substantially along the bottom of said reservoir, whereby temperature stratification of liquid refrigerant in said reservoir is substantially maintained.

13. The flow-through surge receiver according to claim 10, wherein said other means comprises a surge control valve connected between the discharge side of said compressor means and said reservoir and being responsive to variations in the pressure-temperature value in said liquid header relative to the design saturation pressure-temperature value of said condenser means for maintaining the reservoir pressure substantially at a predetermined value and for maintaining liquid refrigerant levels in said reservoir through hydrostatic condensing therein.

14. The flow-through surge receiver according to claim 13, in which said surge control valve has a value control pressure head having a selected pressure charge acting on one direction to open said valve and being opposed by the prevailing receiver pressure acting to close said valve, whereby said control valve is normally modulated to an open position in response to decreasing receiver pressure relative to its saturated temperature.

15. The flow-through surge receiver according to claim 14, wherein said selected pressure charge is contained, in part, in a sensing bulb in heat exchange relation with said liquid header, whereby said surge control valve is modulated to an open position in response to increasing pressures in said sensing bulb relative to its saturated temperature.

* * * * *

UNITED STATES PATENT OFFICE

CERTIFICATE OF CORRECTION

Patent No. 4,621,505 Dated November 11, 1986

Inventor(s) Ares et al

It is certified that error appears in the above-identified patent and that said Letters Patent are hereby corrected as shown below:

Column 5, line 38, "margrn" should be --margin--.

Column 10, (claim 14), line 41, "value" should be --valve--; line 43, "on" should be --in--.

Signed and Sealed this

Tenth Day of March, 1987

*Attest:*

DONALD J. QUIGG

*Attesting Officer*

*Commissioner of Patents and Trademarks*